United States Patent [19]

Whittaker

[11] 4,037,287

[45] July 26, 1977

[54] BUFFING MACHINE PAD CLEANING DEVICE

[76] Inventor: Richard E. Whittaker, 302 S. Croton Ave., New Castle, Pa. 16101

[21] Appl. No.: 714,991

[22] Filed: Aug. 16, 1976

[51] Int. Cl.[2] ..... A46B 17/00

[52] U.S. Cl. ..... 15/257 R; 15/142

[58] Field of Search ..... 15/142, 257

[56] References Cited

U.S. PATENT DOCUMENTS

| | | | |
|---|---|---|---|
| 1,898,887 | 2/1933 | Naul | 15/142 |
| 2,764,776 | 10/1956 | Peguero | 15/142 X |
| 2,977,620 | 4/1961 | Nilsson | 15/142 |
| 3,158,889 | 12/1964 | Lukezick | 15/142 |

*Primary Examiner*—Edward L. Roberts

*Attorney, Agent, or Firm*—Webster B. Harpman

[57] ABSTRACT

A device on which a floor buffing machine may be positioned and operated to remove built up accumulations of wax and dirt from the buffing pad thereof takes the form of a substantially flat elevated apertured surface with a plurality of radially positioned curved bars arranged in an annular pattern over the apertures.

5 Claims, 3 Drawing Figures

BUFFING MACHINE PAD CLEANING DEVICE

BACKGROUND OF THE INVENTION

1. Field of the Invention

This invention relates to devices for cleaning the pads of floor buffing machines.

2. Description of the Prior Art:

No prior art structures are known that are usable with a floor buffing machine for the indicated purpose. The prior art devices for somewhat similar purposes as in receiving a dust mop or the like comprise U.S. Pat. Nos. 1,898,887, 1,943,449, 2,170,528, 2,787,015, 2,863,163 and 2,977,620. With the exception of the device of Patent 1,898,887, the prior art devices would be completely incapable of receiving a floor building machine and the arrangement of the mop cleaner and dust pan of Patent 1,898,887 is such that it would be completely ineffective in attempting to remove wax and built up dirt accumulations from the buffing pad of a floor buffing machine.

This invention provides a novel arrangement of rounded bars in a radial pattern overlying apertures in an otherwise flat supporting surface and particularly suitable for engagement with a buffing pad being rotated thereon by a floor buffing machine to effectively remove wax and dirt accumulations therefrom.

SUMMARY OF THE INVENTION

A buffing machine pad cleaning device is disclosed which includes a slightly elevated platform apertured in the central area thereof and provided with radially positioned bars over the apertures, the hollow interior of the device provides a receptacle for wax and dirt removed by the operation of a floor buffing machine thereon with the buffing pad rotating against the radially positioned bars.

DESCRIPTION OF THE PREFERRED EMBODIMENT

In the form of the invention chosen for illustration herein, the buffing machine pad cleaning device comprises a rectangular flat topped platform 10 having an inclined ramp 11 at one end and oppositely disposed low profile side walls 12 on its opposite sides and a similar low profile end wall 13 on its end opposite the ramp 11.

Figure 1:
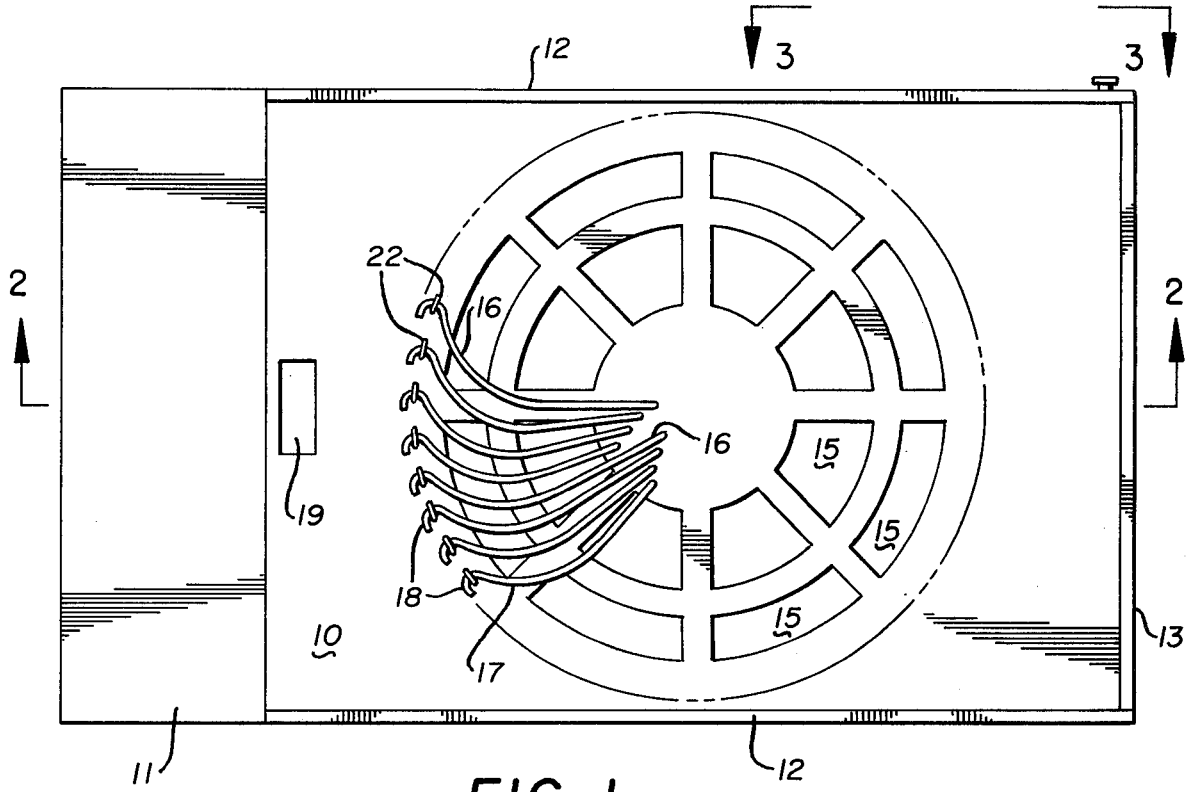
FIG. 1 is a top plan view of the buffing machine pad cleaning device.

A bottom member 14 is spaced below the flat topped platform 10 and defines a hollow space in which wax and dirt accumulations removed from a buffing pad of a buffing machine may be retained. Access to the hollow interior is obtained through a plurality of openings 15 which are best illustrated in FIG. 1 of the drawings, and they are preferably arranged in an annular pattern about a central unbroken area 16 of the platform 10. A plurality of relatively small diameter cross sectionally round bars 17 are arranged in a radial pattern over the openings 15 so that they extend from the unbroken area 16 to the annular portion of the platform 10 around the openings 15. The outer ends of the bars 17 are curved as at 18 and the intermediate portions of the bars 17 between the curved outer ends 18 and their innermost ends which are positioned on the unbroken area 16 are formed in gentle curves as defined by extended arcs. The inner ends of the bars 17 are straight and are staggered with respect to one another so that there are no closely spaced areas therebetween.

Figure 2:
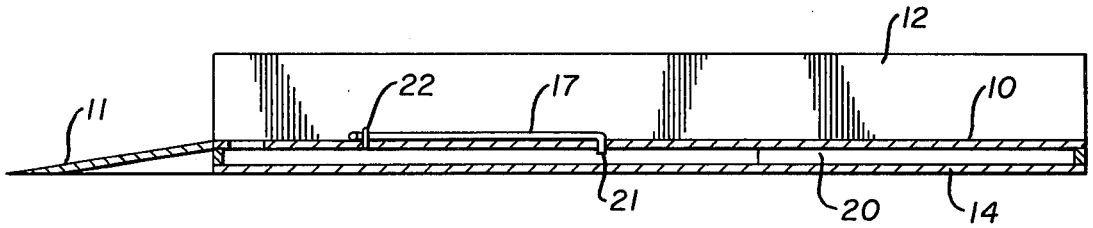
FIG. 2 is a vertical section on line 2—2 of FIG. 1.
Figure 3:
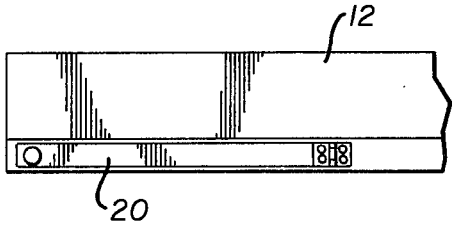
FIG. 3 is a partial side elevation on line 3—3 of FIG. 1.

A hand opening 19 is formed in the platform 10 adjacent the ramp 11 to facilitate picking up the device and carrying it to a desired location. In order that wax and dirt accumulations that fall into the interior of the device as heretofore described can be removed therefrom, a hinged door 20 is provide which is best illustrated in FIG. 3 of the drawings and it is located in the side of the device as seen in FIGS. 1 and 2 of the drawings and provided with a knob so that it can be conveniently opened and the accumulated material removed periodically.

In order that the bars 17 may be retained in position over the openings 15, the inner ends of each of the bars are downturned as at 21 and engaged in apertures in the otherwise unbroken area 16 of the platform 10 and their outermost ends in the areas of the curved end portions 18 are secured to the platform 10 by fasteners 22.

It will thus be seen that a buffing machine pad cleaning device has been disclosed which is of a size and shape defining an area suitable for receiving a floor buffing machine or the like thereon as the same can be moved onto the device and the buffing pad thereof positioned over the openings 15 and in engagement with the curved bars 17.

Operation of the buffing machine revolves the pad relative to the bars 17 and their arrangement and shape causes the buffing pad to be flexed progressively so as to effectively loosen accumulated wax and dirt deposits which otherwise interfere with the efficient use of the buffing pad. The loosened deposits fall through the openings 15 into the interior of the device as hereinbefore described.

The low profile side and end walls 12 and 13 insure against the accidental scattering of wax and dirt particles removed from the buffing pad.

It will thus be seen that a simple and efficient device for cleaning the pads of floor buffing machines has been disclosed and having thus described my invention what I claim is.

I claim:

1. A buffing machine pad cleaning device comprising a raised, substantially flat platform having a plurality of relatively large openings therein, a plurality of bars positioned on and attached to said platform in a radial pattern overlying said openings, said bars defining an area substantially the same size as said buffing machine pad so that the same can be positioned thereon and rotated thereagainst by said buffing machine.

2. The buffing machine pad cleaning device of claim 1 and wherein each of the plurality of bars is formed in an arcuate shape inwardly of its ends.

3. The buffing machine pad cleaning device set forth in claim 1 and wherein each of the bars are cross sectionally round and are formed in an arcuate shape inwardly of their ends.

4. The buffing machine pad cleaning device set forth in claim 1 and wherein the openings (15) are closely spaced with respect to one another in an annular pattern.

5. The buffing machine pad cleaning device set forth in claim 1 and wherein the bars are arcuate in shape between their ends and are positioned in flat contact with the portions of the platform adjacent said openings.

* * * * *